US009011038B2

(12) United States Patent
Buschmann et al.

(10) Patent No.: US 9,011,038 B2
(45) Date of Patent: Apr. 21, 2015

(54) METHOD AND SYSTEM FOR APPLYING A ROAD SURFACE

(75) Inventors: Martin Buschmann, Neustadt (DE); Ralf Weiser, Ladenburg (DE); Arnold Rutz, Ludwigshafen (DE); Achim Eul, Mannheim (DE)

(73) Assignee: Joseph Vogele AG, Ludwigshafen/Rhein (DE)

( * ) Notice: Subject to any disclaimer, the term of this patent is extended or adjusted under 35 U.S.C. 154(b) by 84 days.

(21) Appl. No.: 13/444,200

(22) Filed: Apr. 11, 2012

(65) Prior Publication Data

US 2012/0263530 A1 Oct. 18, 2012

(30) Foreign Application Priority Data

Apr. 18, 2011 (EP) ..... 11003247

(51) Int. Cl.

| | |
|---|---|
| ***E01C 23/07*** | (2006.01) |
| ***E01C 3/06*** | (2006.01) |
| ***E01C 19/12*** | (2006.01) |
| ***E01C 19/00*** | (2006.01) |
| ***E01C 19/48*** | (2006.01) |

(52) U.S. Cl.

CPC ..... *E01C 19/00* (2013.01); *E01C 19/48* (2013.01); *E01C 2301/02* (2013.01)

USPC ..... 404/84.05; 404/72; 404/101

(58) Field of Classification Search

USPC ..... 404/84.05, 101, 72

See application file for complete search history.

(56) References Cited

U.S. PATENT DOCUMENTS

| | | | | |
|---|---|---|---|---|
| 5,100,277 | A * | 3/1992 | Musil | 414/334 |
| 5,471,391 | A | 11/1995 | Gudat et al. | |
| 5,493,494 | A | 2/1996 | Henderson | |
| 5,935,192 | A | 8/1999 | Henderson et al. | |
| 6,244,782 | B1 * | 6/2001 | Bitelli | 404/84.1 |
| 6,805,516 | B2 * | 10/2004 | Barnat et al. | 404/101 |
| 6,862,521 | B1 | 3/2005 | Fox | |
| 6,915,216 | B2 | 7/2005 | Troxler et al. | |
| 7,376,530 | B2 | 5/2008 | Bienvenu et al. | |
| 7,484,911 | B2 * | 2/2009 | Frelich | 404/75 |

(Continued)

FOREIGN PATENT DOCUMENTS

| | | | |
|---|---|---|---|
| CN | 101446059 | A | 6/2009 |
| DE | 19547574 | A1 | 10/1996 |

(Continued)

OTHER PUBLICATIONS

European Search Report mailedOct. 28, 2011, which issued in corresponding EP application No. 11003247.1.

(Continued)

*Primary Examiner* — Abigail A Risic

(74) *Attorney, Agent, or Firm* — Fish & Richardson P.C.

(57) ABSTRACT

A method and a system for applying a road surface using a mixing plant for producing laying material, a road finishing machine processing the laying material to a road surface, and a supply chain transporting the laying material from the mixing plant to the road finishing machine. Request commands are transmitted from the road finishing machine to the mixing plant and/or to the supply chain, and, depending on these request commands, the production rate of the laying material in the mixing plant, the temperature of the laying material produced in the mixing plant, and/or the mass flow of laying material supplied to the road finishing machine per time unit by means of the supply chain are adjusted.

16 Claims, 4 Drawing Sheets

(56) References Cited

U.S. PATENT DOCUMENTS

Figure 1:
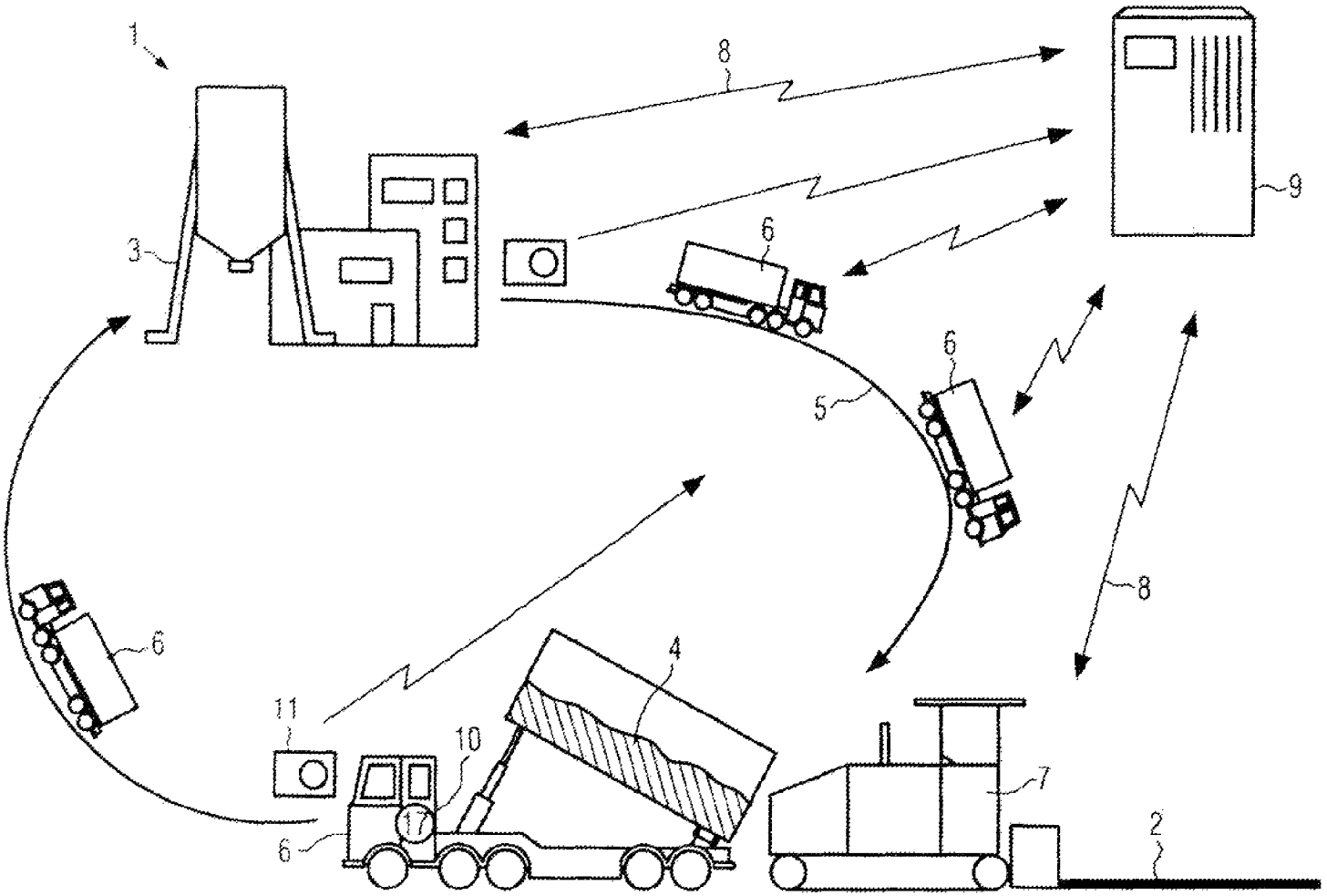

| | | | | |
|---|---|---|---|---|
| 7,572,081 | B2 * | 8/2009 | Buschmann | 404/111 |
| 7,731,450 | B2 | 6/2010 | Congdon et al. | |
| 7,984,184 | B2 | 7/2011 | Woon et al. | |
| 8,099,218 | B2 | 1/2012 | Glee et al. | |
| 8,112,242 | B2 | 2/2012 | Troxler | |
| 2002/0059320 | A1 | 5/2002 | Tamaru | |
| 2002/0182009 | A1 * | 12/2002 | Barnat et al. | 404/111 |
| 2004/0073382 | A1 | 4/2004 | Troxler et al. | |
| 2004/0260504 | A1 | 12/2004 | Bienvenu et al. | |
| 2007/0050137 | A1 | 3/2007 | Woon et al. | |
| 2008/0063473 | A1 | 3/2008 | Congdon et al. | |
| 2008/0249729 | A1 * | 10/2008 | Martinez et al. | 702/84 |
| 2008/0262780 | A1 | 10/2008 | Bienvenu et al. | |
| 2009/0142133 | A1 | 6/2009 | Glee et al. | |
| 2010/0140618 | A1 | 6/2010 | Reinmuth et al. | |
| 2010/0178107 | A1 * | 7/2010 | Braddy et al. | 404/75 |
| 2012/0051839 | A1 * | 3/2012 | Begley et al. | 404/72 |
| 2012/0288328 | A1 * | 11/2012 | Minich | 404/72 |

FOREIGN PATENT DOCUMENTS

| | | | |
|---|---|---|---|
| DE | 19744772 | A1 | 6/1998 |
| DE | 69416006 | D1 | 2/1999 |
| DE | 19755324 | A1 | 6/1999 |
| DE | 19940404 | C2 | 7/2001 |
| DE | 10151942 | A1 | 12/2002 |
| DE | 602004011968 | D1 | 4/2008 |
| DE | 102008058481 | A1 | 7/2009 |
| DE | 102008054481 | A1 | 6/2010 |
| EP | 698152 | A1 | 2/1996 |
| EP | 1314101 | A2 | 5/2003 |
| EP | 1550096 | A2 | 7/2005 |
| EP | 1897997 | A2 | 3/2008 |
| WO | WO9425680 | A1 | 11/1994 |
| WO | WO0070150 | A1 | 11/2000 |
| WO | WO01015001 | A9 | 9/2002 |

OTHER PUBLICATIONS

English translation of Office Action which issued Apr. 2, 2014 in corresponding Chinese Application No. 201201154243.

Kilpelainen, P., Heikkila, R., Parkkila, T., Automation and wireless communication technologies in road rehabilitation, Proceedings of 24th International Symposium on Automation & Robotics in Construction (SARC 2007), Kochi, 19-21, Sep. 2007, pp. 35-40.

Statement of Grounds filed Dec. 16, 2014 in Application for Revocation of Great Britain Patent No. EP (UK) 2514873 B1, filed by Caterpillar Inc. against patent owner Joseph Vogele AG, 32 pages.

* cited by examiner

METHOD AND SYSTEM FOR APPLYING A ROAD SURFACE

BACKGROUND OF THE INVENTION

The present invention relates to a method for applying a road surface using at least one mixing plant for producing laying material, a road finishing machine for applying the laying material to a road surface, and a supply chain for transporting the laying material from the mixing plant to the road finishing machine.

Preparing a road surface is an extremely complex working process. Usually, not only many different working machines, such as, for example, a mixing plant, trucks, feeders, road finishing machines and rollers, are involved in this working process, but also many different persons, sometimes with different degrees of experience. Moreover, the preparation of a road surface is influenced by many factors, for example by the temperature and composition of the laying material, the duration of the transport of the laying material to the construction site, the laying speed, the adjustment of the compacting units at the road finishing machine, or optionally the following roller, and also environmental influences, such as wind, temperature and moisture. All these influences can, individually or in interaction, affect the quality of the prepared road surface. However, it is always the aim to prepare a road surface with the highest possible quality, in particular with a defined degree of compaction of the laying material or with high stability, respectively.

In the past, many suggestions have been already made showing how methods and systems for applying a road surface can be better monitored, controlled or documented in view of more uniform work results. For example, DE 101 51 942 B4 discloses a working machine management system wherein construction vehicles can communicate with each other and with a job-site office. The exchanged data can relate, for example, to information on thefts, construction project costs, component requirement predictions, service requirement predictions, weather data or fuel consumption. DE 60 2004 011 968 T2 describes a further system for exchanging information on sites. Data exchange between mobile construction vehicles and a job-site office is accomplished there by means of an internet protocol. DE 10 2008 054 481 A1 describes an asphalt system wherein the navigation of construction vehicles is based on a so-called position temperature model. The system determines where to best employ compacting vehicles on the basis of the initially assessed and then measured asphalt temperature.

According to US 2004/0260504 A1, asphalt-related measured data can be transmitted in a wireless communication system. DE 101 51 942 B4 describes that a certain identification is allocated to each construction vehicle. Another fleet management system for construction vehicles can be taken from U.S. Pat. No. 6,862,521 B1. WO 00/70150 A1 describes the measurement of the asphalt temperature at a road finishing machine. The measured temperature data are forwarded to a compactor following the road finishing machine.

DE 197 44 772 A1 describes the determination of a local compacting level to inform a compactor how many times he must drive over the stated area. DE 694 16 006 T2 describes a further variant for controlling a compactor, for example a roller. The navigation of a compacting roller depending on the degree of compaction in road construction is also treated in EP 1 897 997 A2.

De 10 2008 058 481 A1, DE 60 2004 011 968 T2 and DE 101 51 942 B4 disclose the inclusion of climate and weather data in site processes. An automatic traffic management system which, however, is not related to site processes can be taken from DE 195 47 574. An automatic navigation of construction site vehicles taking into consideration their positions can be taken, for example, from DE 197 44 772, DE 60 2004 011 968 T2, DE 199 40 404 or DE 197 55 324 A1.

A fleet management system which displays data of mobile working machines and their positions on an internet website is described in EP 1 314 101 A1. EP 1 550 096 discloses a system which measures the quality of the bituminous surface or the quality of the asphalt. A system for determining the compaction of asphalt is discussed in EP 0 698 152 B2. This document discloses specifications for a speed or a lead of a road finishing machine over the following rollers or other compacting machines.

SUMMARY OF THE INVENTION

It is the object of the present invention to improve a method and a system for applying a road surface to the effect that road surface of an even better quality can be prepared.

This object is achieved by the method and the system of the present invention.

Conventional fleet management systems for the construction site operation can sometimes detect the position of individual trucks which supply the laying material to the site. This, however, does not prevent several trucks from accumulating in front of the road finishing machine, for example in delays in the laying process, so that the laying material on the truck cools down to an undesired degree. If the laying material cools down too much, it can even become useless, so that it has to be disposed of in a complicated and time-consuming manner. If the logistic process of the supply chain (which can comprise several trucks) in a conventional system is controlled at all, this is usually done according to the so-called "push principle" wherein a mixing plant produces a certain amount of laying material (for example asphalt) and transports this asphalt mass flow to the site via the supply chain, for example in a truck shuttle traffic. The road finishing machine then must act in accordance with the supplied mass flow of laying material.

The invention is based on the idea that it is far more advantageous for the quality of the prepared road surface to control the construction site logistics according to the so-called "pull principle". In this "pull principle", the focus is on the road finishing machine. It determines the laying speed of the road surface and determines the properties required for this and the amount of laying material. To this end, the road finishing machine generates request commands and transmits them to the mixing plant and/or to the supply chain. These are then adapted to adjust, depending on the respective request commands, the production rate of the laying material in the mixing plant, the temperature of the laying material produced in the mixing plant, and/or the mass flow of laying material per time unit supplied to the road finishing machine by the supply chain.

The advantage of the method according to the invention is that influences, such as the weather, defects, traffic jams, breaks or work-related changes in the speed of the road finishing machine, are directly detected and can now be consulted for controlling the mixing plant and/or the supply chain. If, for example, delays in the laying process result from traffic jams or defects, the rate of production of the laying material in the mixing plant can be slowed down, or the mass flow delivered to the road finishing machine can be reduced. This avoids producing too much laying material or transporting laying material to the site that cannot be laid or accumulates on site and cools down too much. Inversely, this prevents having the laying equipment come to a standstill. A clear improvement in quality is achieved with a laying process that is as uniform as possible. Supply gaps where no truck is on the site are equally grave for the quality of the asphalt as the asphalt cools down t on the truck. As a result, the previously applied asphalt cools down directly behind the finishing machine without it being possible to recompact it. When the machine is started again, there is a risk in that uneven surfaces are generated transversely to the direction of traffic. Quality losses or returns and the complicated disposal of excessively produced laying material can be avoided. Moreover, the provision of an asphalt reserve that is ultimately not used for the laying process can be eliminated. This results in saving resources, costs and energy. Employment of this system and method makes sense both ecologically and economically. If one detects at the road finishing machine that an efficient laying of the supplied laying material can be effected, the temperature of the laying material produced in the mixing plant can be reduced, as this material cools down less due to the efficient laying process. With this approach, energy can be saved.

DETAILED DESCRIPTION OF THE INVENTION

In the method according to the invention, one single mixing plant can be employed, or as an alternative, a plurality of mixing plants can be used and the laying material produced by these plants can be supplied to one or to several sites. In the sense of the invention, a supply chain comprises at least one, preferably several transport vehicles which transport the laying material from the mixing plant or the mixing plants to the road finishing machine. A further embodiment can include a transport chain to several road finishing machines, wherein the road finishing machines lay various mixed asphalt materials which must be supplied in the proper sequence (just in sequence).

Preferably, a demand forecast is established at the road finishing machine, and the request commands are established depending on this demand forecast. The demand forecast can be either established manually or by means of a suited computer program. It assesses which amount of laying material can be processed within a certain period in future.

This demand forecast can in particular take into consideration a work schedule, problems that arise in the laying process or the supply chain, defects, traffic jams and/or weather data. The work schedule determines the intended work result, i.e. the place, the dimensions and the quality of the road surface to be prepared. In the process, one can take into consideration that more complicated geometries, such as gully lids, narrow curves or traffic circles, will lead to a reduction in the laying speed of the road finishing machine. This expected reduced laying speed can be taken into consideration in the demand forecast and lead to appropriate changes at the mixing plant and/or in the supply chain by means of the request commands.

If several mixing plants are provided, preferably a change of the amount of laying material requested by the road finishing machine is distributed proportionally to the maximum capacity of the individual mixing plants or proportionally to the daily amount of laying material ordered from the individual mixing plants according to a key. Using this system promotes uniform operation of the construction process.

In an advantageous embodiment of the method, a feedback signal of the condition of the mixing plant and/or the supply chain is sent to the road finishing machine in certain situations or at regular intervals. In this manner, both a smooth operation of the mixing plant or the supply chain and troubles in the operation of the mixing plant and/or the supply chain can be signaled to the road finishing machine.

Here, it is particularly advantageous if the mass flow of laying material currently present in the supply chain is displayed at the road finishing machine. An operator of the road finishing machine can then adapt the laying speed of the road finishing machine to this mass flow to be received. In this manner, the laying speed can be slowed down to avoid a standstill of the road finishing machine and quality losses caused thereby, for example in case of an imminent undersupply with laying material.

It is suitable if at least one operating parameter of the road finishing machine is adjusted depending on a feedback of the mixing plant or the supply chain with respect to the temperature or the amount of laying material in the supply to the road finishing machine. The operating parameters can be a laying speed of the road finishing machine and/or an operating parameter of a compacting unit of the road finishing machine, for example the speed of tampers or the operating parameters of pressing strips. In this manner, the method according to the invention results in a system operating according to the "pull principle" which, however, permits feedback and consequently an optimization of the operation of the road finishing machine.

In a further variant of the method, transport means of the supply chain can be detected by a marking at the mixing plant and/or on a site. This marking can be a marking that can be read out optically or with electromagnetic radiation and which is in particular detected automatically. By this, the laying process can be further optimized as more precise information on the position of the individual transport means and on the duration of the transport from the mixing plant to the road finishing machine can be gained.

The invention also relates to a system for applying a road surface. In this system, the road finishing machine comprises a control with a communication module which is adapted to generate request commands and to submit them to the mixing plant and/or to the supply chain via a (preferably wireless) communication channel. The mixing plant and/or the supply chain are adapted to adjust, depending on the received request commands, the temperature of the laying material produced in the mixing plant and/or the mass flow of laying material supplied to the road finishing machine per time unit by the supply chain. Thereby, the advantages described above with respect to the method according to the invention result.

It is suitable for the control of the road finishing machine to comprise a demand forecast assessment module by means of which a future demand of the amount and/or temperature of laying material can be evaluated. This demand forecast assessment module can take into consideration, for example, a work schedule stored in the control. Depending on the assessed demand of the amount and/or temperature of laying material, appropriate request commands can be generated and transmitted to the mixing plant and/or to the supply chain via the communication channel.

A display, for example a monitor is provided, preferably, on the road finishing machine or at another place on the site, by means of which the mass flow of laying material currently present in the supply chain can be displayed. Thereby, one can display to the operator of the road finishing machine how much laying material will be available in future time periods.

It is particularly advantageous for the control to be adapted to automatically adjust the laying speed and/or at least one other operating parameter of the road finishing machine depending on feedback on the state of the mixing plant or the supply chain that is received via the communication channel.

In this manner, the operation of the road finishing machine, and by this in the end the quality of the road surface, can be optimized.

In the control, a plurality of data records can be stored which each represent a group of operating parameters adapted to each other. These data records can cover most of the situations usually occurring in the operation of the road finishing machine and provide, for each of these situations, an optimized set of operating parameters. In this manner, the operation of the road finishing machine is further optimized.

Figure 2:
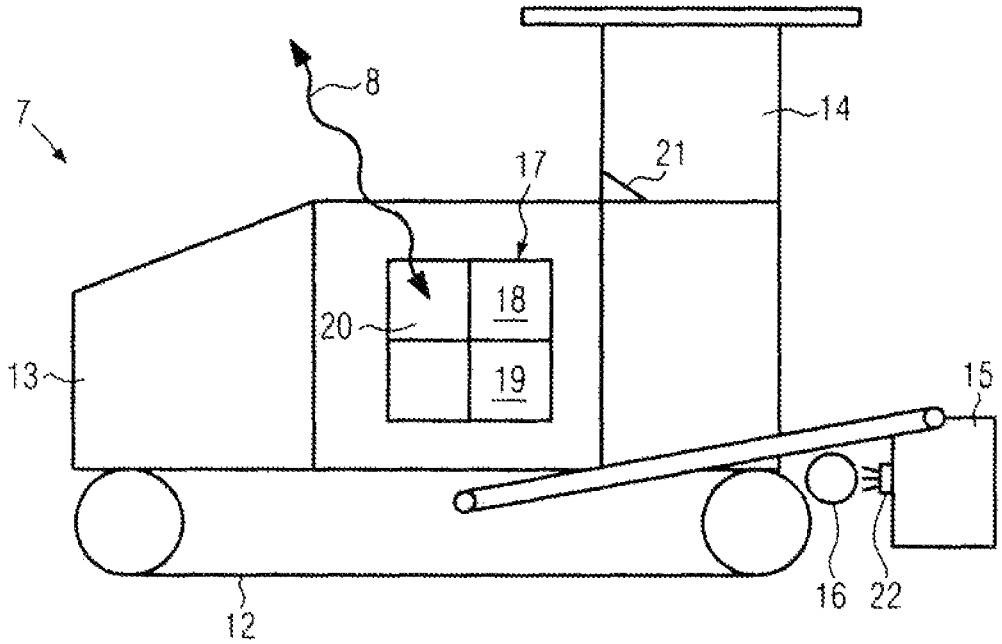
Figure 3:
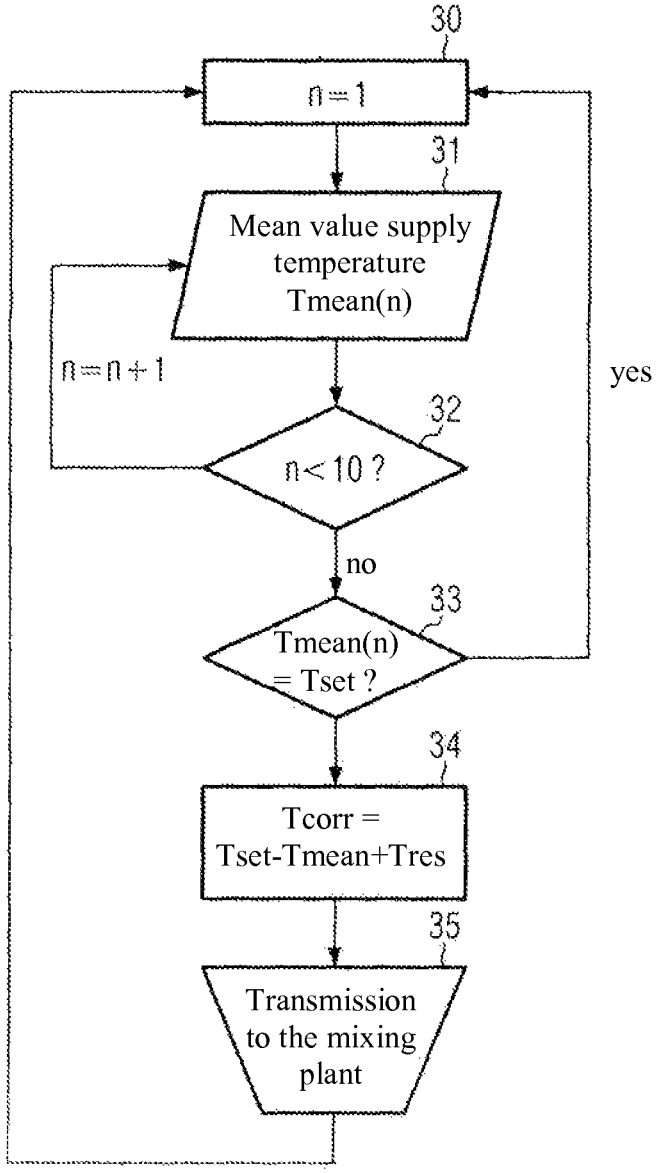
Figure 4:
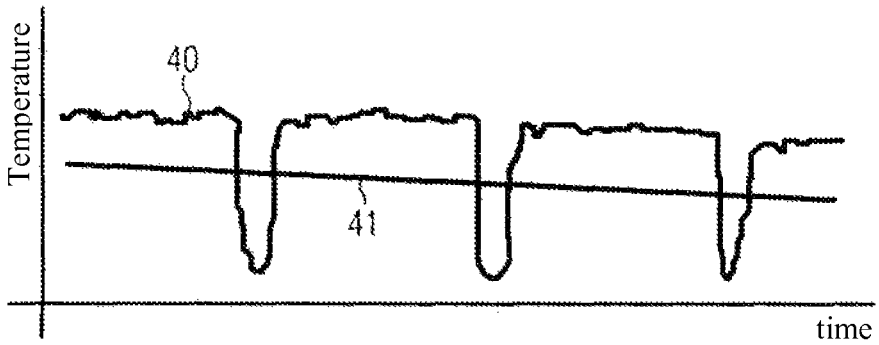
Figure 5:
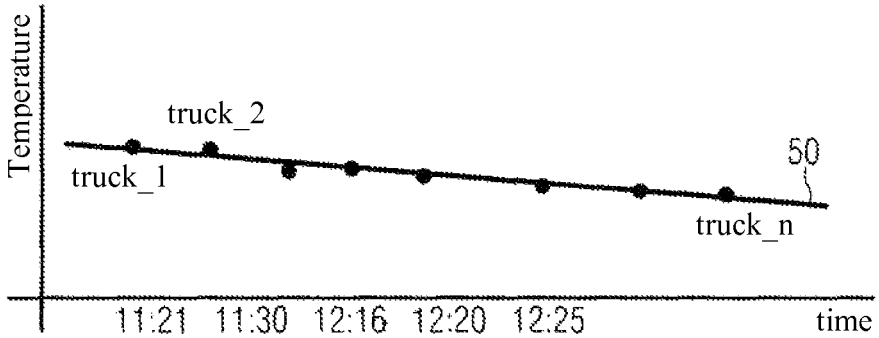
Figure 6:
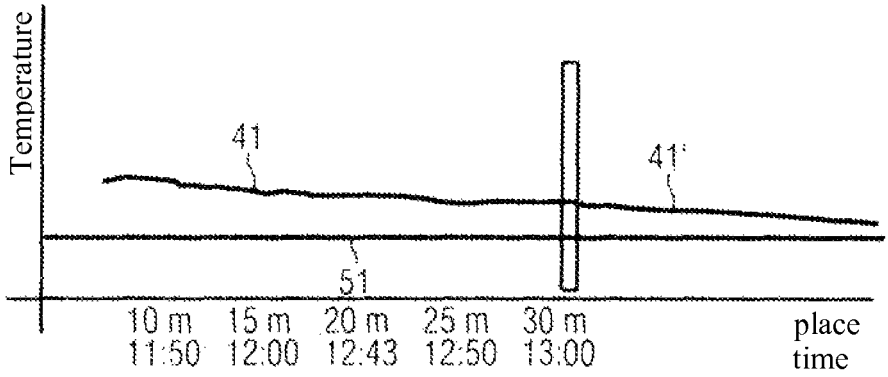

Below, an advantageous embodiment of the invention will be illustrated more in detail with reference to a drawing. The figures show in detail:

FIG. 1 a simplified representation of the system according to the invention, FIG. 2 a representation of the road finishing machine in the system according to the invention, FIG. 3 a flow chart with respect to the detection of temperature values, FIG. 4 the result of an asphalt temperature measurement and the averaging at the road finishing machine, FIG. 5 the development of the loading temperature at the mixing plant over time, and FIG. 6 the measured supply temperature of the laying material on site.

The same components are always provided with the same reference numerals in the figures.

FIG. 1 shows, in a schematic view, a system 1 according to the invention for applying a road surface 2. The system 1 comprises a mixing plant 3 in which laying material 4 (for example concrete or asphalt) is produced. This laying material 4 has a certain temperature when it has been produced at the mixing plant 3. In case of asphalt, this temperature can be, for example, between 130° and 170° Celsius.

At the mixing plant 3, the laying material 4 is forwarded to a supply chain 5. This supply chain 5 comprises several transport vehicles 6, for example trucks. The supply chain 5 transports the laying material 4 from the mixing plant 3 to a road finishing machine 7 which can be some distance away from the mixing plant. The road finishing machine 7 processes the laying material 4 to a road surface 2 which can be subsequently optionally further compacted by compacting vehicles, for example rollers (not shown).

The system 1 according to the invention furthermore comprises a communication channel 8 via which the road finishing machine 7 can communicate wirelessly—for example via an internet protocol, bluetooth, infrared interfaces or the exchange of SMS messages—with the mixing plant 3 and the supply chain 5. A central server 9 with suited communication interfaces forms a part of this communication channel 8. This server 9 can be located, for example, in a job-site office. It receives request commands sent by the road finishing machine 7, manages these request commands and forwards them to the mixing plant 3 or to the transport vehicles 6 of the supply chain 5. The mixing plant is adapted to adjust, i.e. optionally change, the rate of production of the laying material 4 and the temperature of the laying material 4 produced in the mixing plant 3 depending on the request commands received via the communication channel 8. The supply chain 5 is in contrast adapted to adjust the mass flow of laying material 4 supplied to the road finishing machine 7 per time unit, depending on the received request commands.

Each transport vehicle 6 of the supply chain 5 is provided with a marking 10 which represents an identification (ID) of the respective transport vehicle 6. The marking 10 can be, for example, an RFID tag, as an alternative an optically identifiable marking, for example a one- or two-dimensional bar code, or the license number. In the represented embodiment, the truck 6 currently located at the road finishing machine 7 is provided with the marking "17".

For reading out the marking 10 of the respective transport vehicle 10, suited acquisition means or readers 11 are provided at the mixing plant 3 as well as on site. These acquisition means 11 automatically detect the marking 10 of a transport vehicle 6 driving past them. The identification of the detected transport vehicle 6 and the point in time when this transport vehicle 6 has passed the acquisition means 11 are wirelessly transmitted from the acquisition means 11 to the central server 9 to be managed there. The identification of the vehicle can be additionally also detected at other points which are of interest for the process, e.g. at site approach roads.

FIG. 2 schematically shows a road finishing machine 7 employed in the system according to the invention. This road finishing machine in a usual manner comprises a running gear 12, a material bunker 13 for accommodating the laying material 4, a control platform 14, a screed provided for compacting the road surface 2, and a transverse spreader screw 16 arranged in front of the screed 15. A central control 17 of the road finishing machine controls the operational process of the road finishing machine 7. This control 17 comprises, among other things, a memory 18, a demand forecast assessment module 19 and a communication module 20. At the control platform 14, a display 21 is provided, for example in the form of a monitor. In the proximity of the transverse spreader screw 16, for example at the screed 15, one or several temperature sensors 22 are provided which detect the temperature of the laying material 4 at the transverse spreader screw 16 and transmit it to the control 17. As an alternative, the distribution of the asphalt temperature can be detected by several sensors which are mounted behind the screed, or by a scanner mounted at the rear side of the roof of the finishing machine which scans the road width.

Below, the operation of the system 1 according to the invention and the sequence of the method according to the invention, respectively, will be illustrated with reference to an example.

Before the project is started, a work schedule is established and stored in a computer. This work schedule determines the geometry, the thickness, the degree of compaction and all other relevant parameters for describing the road surface 2 to be prepared. The work schedule is transmitted to the road finishing machine 7 to be stored there in the memory 18 of the control 17.

The mixing plant 3 produces laying material 4, for example asphalt. The transport vehicles 6 of the supply chain 5 are loaded with the laying material 4 at the mixing plant to subsequently transport the laying material 4 to the site and in particular to the road finishing machine 7. The control 17 controls the road finishing machine 7 such that it can prepare the road surface with a preferably constant laying speed. During the laying process, the temperature sensors 22 monitor the temperature of the laying material 4 at the transverse spreader screw 16 (or at any other point at the road finishing machine 7, if this seems to be suitable). From the current laying speed and the asphalt temperature measured at the temperature sensors 22, and taking into consideration the stored work schedule and optionally external influences, such as weather data, the demand forecast assessment module 19 of the control 17 calculates a demand forecast. This forecast indicates how much laying material 4 is required at what temperature in which periods to come to allow the laying process to be performed as uniformly as possible. For example, the demand forecast assessment module 19 could calculate how much laying material 4 will be required at what temperature within the 30 minutes to come, within the next 30 minutes, etc.

On the basis of the demand forecast, request commands are generated in the control 17 and transmitted to the central server 9 via the communication channel 8. From there, the request commands are further transmitted to the mixing plant 3 and/or to the supply chain 5 via the communication channel 8. In response to the request commands, the mixing plant 3 can increase or reduce the temperature of the produced laying material 4. For example, the temperature of the laying material 4 can be increased if it turns out that the transport vehicles 6 take more time than expected for the transport to the site. With this temperature request, it can be taken into consideration that asphalt on a truck cools down, for example, by about 8° C. per hour. If the demand forecast shows that in future periods, a slow laying of the road surface 2 is to be expected, for example in narrow curves or complicated road geometries, for this period to come, a smaller mass flow of laying material 4 can be requested to avoid unnecessary waiting times of the laying material 4 on site. So, in these periods to come, the supply chain 5 would supply less laying material 4 to the road finishing machine 7.

For the measurement of temperature at the road finishing machine, an average determination is consulted which is illustrated with reference to FIG. 3. This average determination has the purpose of eliminating a change of request due to freak values. In step 30, the method starts with a first temperature measurement at the temperature sensor 22. The counter n receives the value n=1.

In step 31, a mean value $T_{mean}$ (n) is determined from all n measured temperature values detected up to then. In step 32, there is a request whether the number n of the measured temperature values detected up to now is already 10 (or another value, if more or less measured values are to be averaged). If this is not the case, a new temperature measurement is carried out, the number n of measurements is increased by 1, and in step 31, a new mean value is determined.

After the predetermined number of temperature measurements (in the example ten) has been performed, the method continues with step 33. There, it is verified whether the temperature mean value $T_{mean}$ (n) corresponds to a set value $T_{set}$, at least within given tolerance ranges. If this is the case, the method starts again with a new temperature measurement in step 30. If, however, the averaged temperature deviates from the predetermined set value Tset, in the following step 34, a temperature correction value $T_{corr}$ is calculated. This value consists of the difference between the temperature value $T_{set}$ and the mean value $T_{mean}$ to t which moreover a temperature reserve $T_{res}$ can be added. This temperature reserve $T_{res}$ allows for a reserve for possible delays in the supply of the laying material 4 to the road finishing machine. In step 35, the correction value $T_{corr}$ is then transmitted from the communication module 20 of the control 17 to the responsible person on site and to the mixing plant 3 via the communication channel 8, whereupon the mixing plant 3 changes the temperature of the prepared laying material 4. Via the identifiable trucks and the corresponding mixing plants, the production temperatures of several mixing plants can be monitored in parallel and the laying temperature can be homogenized.

In an example, the mixing plant 3 produces asphalt 4 of a temperature of 142° C. A truck 6 transports this asphalt material 4 to the site within a travel time of 45 minutes. With a cooling rate of 8° C. per hour, the laying material 4 cools down by 6° C. during transport, so that it still has a temperature of 136° C. when it gets to the road finishing machine. The set temperature at the road finishing machine 7 in the laying process, however, is $T_{set}$=120° C. This means, the laying material 4 could be produced at the mixing plant 3 with a temperature lower by 16° C. However, now a temperature reserve $T_{res}$ of 2° C. is allowed for possible delays in the travel time of the truck 6 by 15 minutes. The correction value $T_{corr}$ transmitted to the mixing plant 3 therefore is (120−136+2) degree Celsius=−14° C. In response to the receipt of this request command, the mixing plant 3 now prepares the asphalt 4 with a new temperature of 128° C.

In particular in so-called low-temperature asphalt, the keeping of the correct temperature plays a decisive role in terms of quality and ecological aspects.

FIG. 4 shows, in a temperature-time diagram, the temperature curve 40 at the temperature sensors 22 as well as the development of the mean value 41 obtained by the average determination according to FIG. 3 over time. The temperature curve 40 shows three "collapses" where the measured temperature falls considerably. These temperature collapses each characterize the end of the tipping procedure of a transport vehicle 6. The determination of a mean value 41 compensates these temperature collapses. The falling of the mean temperature $T_{mean}$ over time is conditioned by the storage of the produced laying material 4 at the mixing plant 3 and the resulting cooling down of the laying material 4.

The current temperature of the laying material 4 at the mixing plant 3 can be either detected at the mixing plant 3 itself during loading and be forwarded to the system 1 via an interface, or it can be subsequently entered manually via the specifications on the delivery note.

FIG. 5 shows the development of the mean temperature 50 over time, wherein now the points in time of the arrival of the individual transport vehicles 6 at the road finishing machine 7 are stated by points.

FIG. 6 shows again the development of the mean value 41 of the measured temperature over time. On the X-axis in FIG. 6, not only the time, but also a statement of place is given. It designates the length (technical term: station) by which the laying process has already progressed since a certain zero point. A vertical bar at the time 1.00 pm or at the statement of place "30 m" designates the current point in time. From the former course of the temperature mean value curve 41, the future is now extrapolated to thus assess the further development of the temperature mean value curve 41' beyond the current point in time. Simultaneously, FIG. 6 shows a minimal temperature 51. The laying material 4 can only be processed if it at least has a minimum temperature 51. The intersection of the extrapolated temperature mean value curve 41' and the minimum temperature 51 designates the point in time in the future up to which the laying process can be continued.

Diagrams as the diagrams represented in FIGS. 4 to 6 can be displayed to the operator of the road finishing machine 7 on the display device 21, so that the operator obtains an overview of the development of the temperature of the laying material 4. In addition, the supply chain 5 can submit information to the road finishing machine 7 via the communication channel 8 showing what amount of laying material 4 is at present on its way to the road finishing machine 7 and when the arrival of the individual transport vehicles 6 is expected on site. The mixing plant 3 can also transmit data to the road finishing machine 7 with respect to the temperature and amount of the prepared laying material 4 and the points in time of the discharge of certain delivery quantities to the transport vehicles 6 by means of the communication channel 8. The control 17 of the road finishing machine 7 processes this information and informs the operator of the road finishing machine 7 about the amount of laying material 4 expected in time intervals to come by means of the display device 21. Taking into consideration this information, either the control 17 can adjust the operating parameters of the road finishing machine 7, in particular its laying speed, automatically, or the operator can do this manually. If any troubles occur, for example traffic jams or a failure of trucks 6 along the supply chain 5, or a failure or production choke points in mixing plants 3, the laying process of the road finishing machine 7 can be slowed down to avoid interruptions of the laying process which would deteriorate quality.

If several mixing plants 3 are provided, a change of the mass flow of laying material 4 requested by the road finishing machine 7 can be distributed to the individual mixing plants 3 according to a key proportionally to the maximum capacity of the individual mixing plants 3 or proportionally to the daily amount of laying material 4 ordered from the individual mixing plants 3.

The invention claimed is:

1. Method of applying a road surface using at least one mixing plant for producing laying material, a road finishing machine processing the laying material to a road surface, and a supply chain transporting the laying material from the mixing plant to the road finishing machine, which comprises transmitting request commands from the road finishing machine to the mixing plant and/or to the supply chain, and adjusting the temperature of the laying material produced in the mixing plant, the method further comprising providing feedback on the condition of the mixing plant to the road finishing machine and adjusting at least one operating parameter of the road finishing machine depending on a feedback received from the mixing plant.

2. Method according to claim 1, which comprises establishing a demand forecast and establishing the request commands using the information in the demand forecast.

3. Method according to claim 2, wherein establishing the demand forecast comprises considering a work schedule, problems in the laying process or the supply chain, defects, traffic jams and/or weather data.

4. Method according to claim 1, which comprises displaying the mass flow of laying material currently located in the supply chain at the road finishing machine.

5. Method according to claim 1, wherein the operating parameter is a laying speed of the road finishing machine and/or an operating parameter of a compacting unit of the road finishing machine.

6. Method according to claim 1, which comprises employing a marking on the transport means of the supply chain and detecting the presence of the marking at the mixing plant and/or on a construction site.

7. The method of claim 1, further comprising adjusting at lleast one of the production rate of the laying material in the mixing plant and the mass flow of laying material supplied to the road finishing machine per time unit by the supply chain.

8. Method according to claim 7, which comprises providing more than one mixing plant, and distributing a change of the mass flow of laying material requested by the road finishing machine to the individual mixing plants according to a key proportionally to the maximum capacity of the individual mixing plants or proportionally to the daily amount of laying material ordered from the individual mixing plants.

9. A system for applying a road surface with a road finishing machine that deposits a laying material on the road surface, and including, a mixing plant for producing the laying material, and a supply chain for transporting the laying material from the mixing plant to the road finishing machine wherein the road finishing machine comprises a control unit having a communication module that generates request commands and transmits the commands over a communication channel to the mixing plant and/or the supply chain, and the mixing plant and/or the supply chain is adapted to adjust the temperature of the laying material produced in the mixing plant based on information contained in the request commands, wherein the control unit is adapted to automatically adjust the laying speed and/or at least one other operating parameter of the road finishing machine depending on a feedback information received over the communications channel about a condition of the mixing plant or the supply chain.

10. The system according to claim 9, wherein the control unit comprises a demand forecast assessment module that determines the amount and/or temperature of laying material that will be required in the future.

11. The system according to claim 9 which comprises a display positioned on the road finishing machine for displaying the mass flow of laying material currently located in the supply chain.

12. The system according to claim 9 wherein, a plurality of data records is stored in the control unit and each data record represents a group of operating parameters that have been adjusted with respect to each other.

13. The method of claim 9 wherein the mixing plant and/or the supply chain is further adapted to adjust at least one of the production rate of the laying material produced in the mixing plant and the mass flow of laying material supplied to the rod finishing machine per time unit by the supply chain based on information contained in the request commands.

14. A method for improving the efficiency of applying a road surface that employs at least one mixing plant for producing laying material, a road finishing machine that deposits the laying material to create a road surface and a supply chain that transports the laying material from the mixing plant to the road finishing machine, the method comprising generating at least one request command from the road finishing machine including information on at least the temperature of the laying material produced in the mixing plant, and/or the mass flow of laying material supplied to the road finishing machine per time unit collected from a plurality of sensors, integrating the collected information in a computer module to create a request command, transmitting the at least one request command from the road finishing machine to the mixing plant and/or to the supply chain, adjusting to the temperature to the laying material produced in the mixing plant in response to information contained in the request command, providing feedback on the condition of the mixing plant to the road finishing machine and adjusting at least one operating perimeter of the road finishing machine depending on a feedback received from the mixing plant.

15. The method of claim 14 which comprises wirelessly transmitting the request command from the road finishing machine the mixing plant.

16. The method of claim 14 further comprising adjusting at least one of the production rate of the laying material in the mixing plant and and the mass flow laying material supplied to the road finishing machine per time unit in response to information contained in the request command.

* * * * *